US007547330B2

(12) United States Patent
Erdemir

(10) Patent No.: US 7,547,330 B2
(45) **Date of Patent: *Jun. 16, 2009**

(54) METHODS TO IMPROVE LUBRICITY OF FUELS AND LUBRICANTS

(75) Inventor: Ali Erdemir, Naperville, IL (US)

(73) Assignee: UChicago Argonne, LLC, Chicago, IL (US)

( * ) Notice: Subject to any disclaimer, the term of this patent is extended or adjusted under 35 U.S.C. 154(b) by 631 days.

This patent is subject to a terminal disclaimer.

(21) Appl. No.: 10/903,705

(22) Filed: Jul. 30, 2004

(65) Prior Publication Data

US 2005/0009712 A1 Jan. 13, 2005

Related U.S. Application Data

(63) Continuation-in-part of application No. 10/027,241, filed on Dec. 20, 2001, now Pat. No. 6,783,561.

(60) Provisional application No. 60/257,829, filed on Dec. 21, 2000.

(51) Int. Cl.
*C10L 1/12* (2006.01)

(52) U.S. Cl. ..... 44/314

(58) Field of Classification Search ..... 44/314
See application file for complete search history.

(56) References Cited

U.S. PATENT DOCUMENTS

| | | | | |
|---|---|---|---|---|
| 2,614,985 A | | 10/1952 | Cook | |
| 2,763,617 A | * | 9/1956 | Roddick et al. | 508/185 |
| 3,779,918 A | | 12/1973 | Ikeda et al. | |
| 4,297,227 A | | 10/1981 | Witte et al. | |
| 4,339,339 A | | 7/1982 | Maciejewski | |
| 4,440,656 A | | 4/1984 | Horodysky | |
| 4,522,629 A | | 6/1985 | Horodysky et al. | |
| 4,522,632 A | | 6/1985 | Horodysky et al. | |
| 4,536,188 A | | 8/1985 | de Witt et al. | |
| 4,541,941 A | | 9/1985 | Horodysky et al. | |
| 4,695,293 A | | 9/1987 | Kessler | |
| 4,735,146 A | | 4/1988 | Wallace | |
| 4,801,390 A | | 1/1989 | Robson | |
| 4,935,164 A | | 6/1990 | Wessling et al. | |
| 5,090,966 A | * | 2/1992 | Crawford et al. | 44/314 |
| 5,130,352 A | | 7/1992 | Chow | |
| 5,173,204 A | | 12/1992 | Chiddick et al. | |
| 5,202,036 A | | 4/1993 | Ripple et al. | |
| 5,234,977 A | | 8/1993 | Bastioli et al. | |
| 5,352,721 A | | 10/1994 | Takayanagi et al. | |

(Continued)

FOREIGN PATENT DOCUMENTS

EP 0450630 A1 10/1991

(Continued)

*Primary Examiner*—Cephia D Toomer
(74) *Attorney, Agent, or Firm*—Foley & Lardner LLP

(57) ABSTRACT

A method for providing lubricity in fuels and lubricants includes adding a boron compound to a fuel or lubricant to provide a boron-containing fuel or lubricant. The fuel or lubricant may contain a boron compound at a concentration between about 30 ppm and about 3,000 ppm and a sulfur concentration of less than about 500 ppm. A method of powering an engine to minimize wear, by burning a fuel containing boron compounds. The boron compounds include compound that provide boric acid and/or $BO_3$ ions or monomers to the fuel or lubricant.

3 Claims, 16 Drawing Sheets

U.S. PATENT DOCUMENTS

| | | | | |
|---|---|---|---|---|
| 5,384,352 | A | 1/1995 | Andres et al. | |
| 5,413,697 | A * | 5/1995 | Fletcher et al. | 208/89 |
| 5,431,830 | A | 7/1995 | Erdemir | |
| 5,478,367 | A | 12/1995 | Sexton et al. | |
| 5,518,510 | A | 5/1996 | Daly et al. | |
| 5,616,153 | A | 4/1997 | Mike et al. | |
| 5,854,182 | A | 12/1998 | Swami et al. | |
| 6,025,306 | A | 2/2000 | Erdemir | |
| 6,368,369 | B1 | 4/2002 | Sanduja et al. | |
| 6,719,814 | B1 * | 4/2004 | Lin | 44/398 |
| 6,783,561 | B2 * | 8/2004 | Erdemir | 44/314 |
| 2002/0038776 | A1 * | 4/2002 | Walsh | 208/61 |

FOREIGN PATENT DOCUMENTS

| | | |
|---|---|---|
| GB | 712881 | 8/1954 |

* cited by examiner

METHODS TO IMPROVE LUBRICITY OF FUELS AND LUBRICANTS

CROSS-REFERENCES TO RELATED APPLICATIONS

This application claims priority to and is a continuation-in-part of U.S. patent application Ser. No. 10/027,241, filed Dec. 20, 2001, which in turn claims priority to U.S. Provisional Patent Application No. 60/257,829, the entire contents of which are incorporated herein by reference.

GOVERNMENT RIGHTS

This invention was conceived under Contract No. W-31-109-ENG-38 between the U.S. Department of Energy (DOE) and the University of Chicago representing Argonne National Laboratories. The United States Government has certain rights in this invention.

FIELD OF THE INVENTION

This invention pertains generally to lubricant and fuel composition containing boron ions and molecules for improved lubricity and methods relating to the same.

BACKGROUND OF THE INVENTION

Sulfur is found naturally in crude oil and carries through into diesel and gasoline fuels unless specifically removed through distillation. As a result, diesel and gasoline fuels used in engines may contain sulfur in concentrations up to 3000 parts per million (ppm). At such high concentrations, sulfur provides high lubricity in fuel pumps and injector systems that deliver the fuel to the combustion chamber in an engine. However, fuel sulfur also causes polluting emissions, particularly $SO_2$ and soot particles, and poisons the advanced emission-control and after treatment devices that are being developed to enable diesel engines to meet progressively more stringent emissions standards. Sulfur dioxide emissions are associated with environmental problems such as acid rain. However, when the current sulfur level is reduced in fuels, high friction and wear occur on sliding surfaces of fuel delivery systems and cause catastrophic failure.

Fuels with lower sulfur content have lower lubricity compared to those with higher sulfur content. Thus, low-sulfur diesel fuels do not provide sufficient lubricity for use in diesel engines, and the use of low-sulfur diesel fuels results in high friction and catastrophic wear of fuel pumps and injectors. When lubricity is compromised, wear increases in fuel injection systems, most of which were originally designed with the natural lubricating properties of traditional diesel fuel in mind. The lower lubricity of low-sulfur fuels poses significant problems for producers as well as for end-users of diesel fuels. Reduction in lubricity also contributes to a loss in useable power due to the increased friction the engine has to overcome. Because fuels with lower sulfur contents exhibit increased friction characteristics compared to fuels with higher sulfur contents, a perfectly tuned engine experiences a noticeable drop in efficiency when the fuel is changed from a high-sulfur fuel to a low-sulfur fuel. The typical diesel fuel currently used by trucks is a high-sulfur diesel fuel having a sulfur content of about 500 ppm. Low-sulfur diesel fuels have a sulfur content of approximately 140 ppm. Ultra low-sulfur diesel fuels have a sulfur content of 3 ppm. Fischer Tropsch fuels, the cleanest of all fuels, have a sulfur content of approximately zero. Because of its zero sulfur content, Fischer Tropsch fuel is an attractive diesel fuel, creating the least amount of pollution. Unfortunately, because it contains zero sulfur, it has no lubricity at all. Thus, Fischer Tropsch fuel causes the highest wear damage on sliding test samples. If it were used in today's engines, it would cause the instant failure of fuel pumps and injectors. Thus, it is not sufficient to simply reduce the sulfur content of fuels, because doing so would rob diesel fuels of their value as effective lubricants.

New mandates by the Environmental Protection Agency (EPA) call for the reduction of sulfur in diesel fuels to levels as low as 40 ppm in 2004 and to 15 ppm beginning Jun. 1, 2006. Such a move would quickly lead to the catastrophic failure of diesel fuel system components. The same requirements are also in place in Europe and Japan. The United States has been closely monitoring the use of low-sulfur fuels around the world. In Sweden and Canada, low-sulfur diesel fuels have been used for several years. Problems with increased wear have been encountered in both countries. The wholesale introduction of low-sulfur fuel in Sweden has had a disastrous effect on diesel engine operation. Swedish refiners are now using additives to prevent excessive wear in fuel injection systems, and their problems are apparently under control. Certain major Canadian refining companies are also adding lubricants before delivering low-sulfur fuels to customers.

The American Society of Tool and Manufacturing Engineers (ASTME), the Society of Automotive Engineers (SAE), and the International Organization for Standardization (ISO), have not yet set fuel lubricity specifications for supplying or testing low-sulfur fuels. Because of added costs, refiners are unlikely to consider supplying a pre-additized fuel before a specification has been set. Until the lubricity specification is written and followed, responsibility rests with diesel equipment end users to use fuel additives to maintain the reliability of their diesel engines.

A common approach to the problem of low-sulfur fuels has been to add lubricant compositions to fuels that reduce friction in internal combustion engines. Various patents disclose additives formulated as lubricating oils and blended into fuels. Alcohols are well known for their lubricity properties when included in lubricating oil formulations. Alcohols are also known for their water-scavenging characteristics when blended into fuels. The use of vicinal hydroxyl-containing alkyl carboxylates, such as the ester glycerol monooleate, have also found widespread use as lubricity additives or as components in lubricating oil compositions.

Borated lubrication compounds are well known lubrication additives for fuel compositions. Borated lubrication compounds are known to have high viscosity indices and favorable low temperature characteristics. Such boron-containing compounds are known to be non-corrosive to copper, to possess antioxidant and potential antifatigue characteristics, and to exhibit antiwear and high temperature dropping point properties for greases. Borated esters and hydrocarbyl vicinal diols have long been proposed as fuel or lubricant additives, especially as mixtures of long chain alcohols or hydroxyl-containing aliphatic, preferably alkyl, carboxylates. Borated lubrication compounds are generally obtained by synthetic methods known in the art. Typically, these borated lubrication compounds are prepared by reacting boric acid or boric oxide with appropriate aliphatic or alkoxylated compounds.

Borated derivatives of phosphorus are also known additives for liquid fuel or lubricant compositions. Such borated phosphorus derivatives include borated dihydrocarbyl hydrocarbylphosphonates. Borated phosphite additives may be synthesized by reacting dihydrocarbyl phosphites with such boron-containing compounds as boric oxide, metaborates, alkylborates or boric acid in the presence of a hydrocarbyl vicinal diol.

Organometallic boron-containing compounds are yet another class of fuel additives. In low-sulfur fuels, such organometallic compounds effect a lowering of the ignition temperature of exhaust particles in diesel engines equipped with an exhaust system particulate trap. Organometallic compounds contain a metal capable of forming a complex with an organic compound. Useful metals for use in such compounds include Na, K, Mg, Ca, Sr, Ba, Ti, Zr, V, Cr, Ni, Mn, Fe, Co, Cu, Zn, B, Pb, and Sb. Borated versions of such organometallic complexes are derived or synthesized from both aliphatic and heterocyclic organic compounds.

Although various patents describe boron-containing additives that provide lubricity to fuel compositions, all the conventional additives are based on compositions that require prior synthesis before addition to the fuel. Some, such as phosphates and amines, require complex formulations and lengthy preparation, and therefore are not cost effective as fuel ingredients. These synthetics have not readily been taken up to replace sulfur in fuel compositions.

In terms of cost and effectiveness, the synthetics are impractical for several reasons. First, large amounts of additives are needed in order to achieve the same level of lubricity that a sulfur concentration of 500 ppm can provide in fuels. In addition, some of the current additives are "one shot" or "point-of-use" additives. These have to be added to the fuel tank at refills because they cannot easily be incorporated into the distillation processes in refiners. Other additives may fail when fuel injectors begin to operate at high pressures, such as 30,000 psi, because higher pressures mean smaller clearances between an injector's plunger and barrel, which results in more opportunity for engine wear. These higher pressures will soon be required by the EPA as part of the more advanced emission control technologies. Finally, the current additives may harm metallic or plastic fuel system components by causing corrosion and producing deposits in the long run.

Thus, a need remains for a readily available ingredient that can be easily and simply combined with low-sulfur fuel compositions to provide an additive that is inexpensive, non-toxic, and confers enhanced lubricity to low-sulfur fuels.

SUMMARY OF THE INVENTION

The present invention relates to methods for providing lubricity in fuels and lubricants, to fuel and lubricant compositions that include boron, and to a method of powering engines to minimize wear.

The present invention provides for boron additives that, when mixed with either low-sulfur or sulfur free diesel and gasoline fuels, solve the friction, galling, and severe wear problems encountered with sulfur free fuels. The increase in lubricity that occurs upon addition of the boron compounds or boric acid of the invention to low-sulfur fuels results in lower wear in fuel pumps and injector systems. The replacement of sulfur in fuels with boron compounds provides for a cleaner environment, at a low cost relative to other additive technologies currently in use. The inventive approach should stimulate increased use of sulfur-free diesel and gasoline fuels. Easy adaptation by industry is possible, since the additives are easily and cheaply obtained and can be mixed directly with fuels without the necessity for any intervening chemical synthesis, or the use of other ingredients of questionable toxicity. Alcohol containing gasoline fuels can also be formulated with these inventive boron additives.

Demonstration of the application and use of these additives in diesel fuels should generate immediate and widespread industrial interest. Primary beneficiaries should be the companies that manufacture diesel engines and those that produce diesel fuels. The production and use of small size diesel engines in passenger cars providing very good fuel economy and very low emissions will also be feasible. Use of the boron compounds and additives should lead to a cleaner environment and longer engine life. Thus, people who drive and live or work in areas where diesel powered transportation systems are used will also benefit from this technology.

The invention provides a method for providing lubricity in a fuel or lubricant such as an oil product. The method includes adding a boron compound (primarily based on boron, oxygen and hydrogen) or boric acid to a fuel and/or oil to provide a boron-containing fuel or lubricant. The additives of the present invention can be any simple boron compound that dissolves in a common solvent to form a solution, preferably fully miscible with a diesel or gasoline fuel or a lubricant, to produce a concentration of boric acid molecules and/or $BO_3$ ions or monomers in the fuel or lubricant composition. Suitable boron compounds for use in providing increased lubricity in a fuel or lubricant include, but are not limited to, boric acid, borax, boron oxide, nanometer-sized boric acid powders, trimethylborate, trimethoxyboroxin or combinations of these. The fuels to be used with the invention may contain a boron compound at a level of from about 30 ppm to about 3,000 ppm, and a concentration of sulfur of less than about 500 ppm. Lubricants to be used with the invention may contain a boron compound such as a borate, boroxin or combination thereof at a concentration of about 100 to about 80,000 ppm.

Suitable fuels for use with the present methods for providing lubricity in a fuel include, but are not limited to, diesel, gas, kerosene, dimethyl ether, liquid propane gas, liquid propane fuels, liquefied natural gas, or combinations of these.

Suitable lubricants for use with the present methods for providing lubricity in a lubricant include, but are not limited to, oil products such as base or formulated vegetable oils, mineral oils, synthetic oils, greases and combinations thereof. Glycols such as polyethylene glycol and combinations thereof can also be used as a lubricant with inventive methods.

In certain embodiments of the invention the boron compound or boric acid is added to a solvent prior to adding the boron compound to the fuel. In such embodiments the solvent may be an alcohol, such as methanol or ethanol. In one embodiment of the invention, a concentrated methanolic solution of boric acid is mixed with a low-sulfur or sulfur free diesel fuel, providing a boric acid concentration of from about 200 to about 2000 ppm in the fuel.

A method of powering an engine to minimize wear is also provided. The method includes burning a fuel which may have a sulfur content of less than about 150 ppm, wherein the fuel contains a boron compound or boric acid at a concentration of from about 30 ppm to about 3,000 ppm. An average wear scar diameter of less than about 0.40 mm occurs under standard conditions when such a method is used.

DETAILED DESCRIPTION OF THE INVENTION

Figure 1:
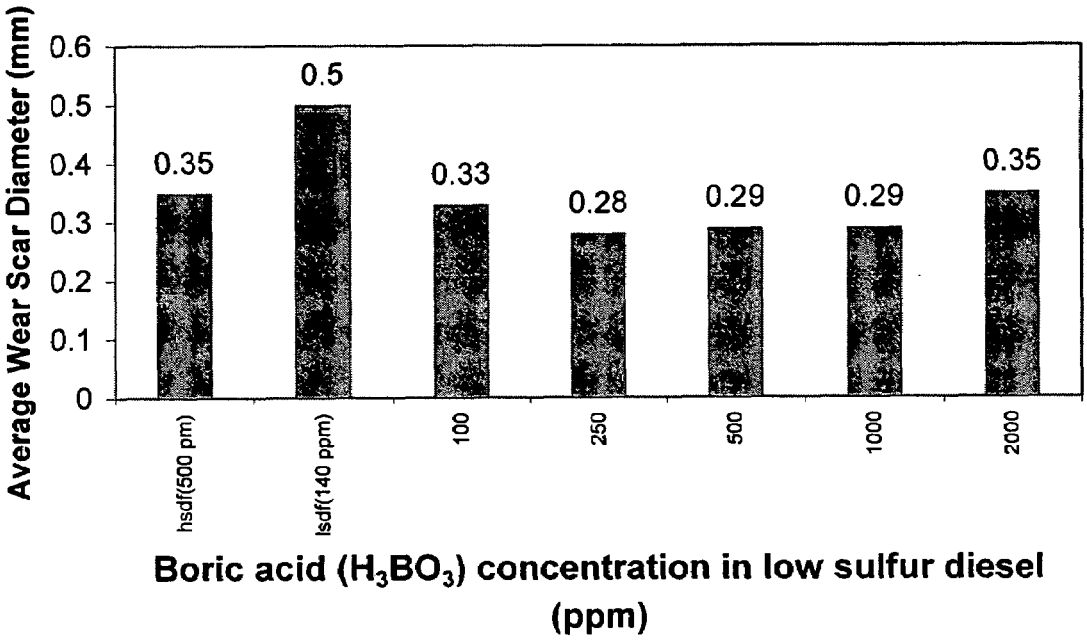
FIG. 1 is a bar graph showing the effects of methanolic solutions of boric acid on the lubricity performance, as measured by the wear scar diameter according to standard conditions described herein, of low-sulfur (140 ppm sulfur content) diesel fuel.

Generally, the present invention provides a method for providing enhanced lubricity in a fuel. The same concept can be used to achieve lubricity in oil products, such as, mineral, vegetable, and synthetic base and formulated oils and greases, as well as other lubricants such as polyethylene glycols. The inventive approach exploits a family of simple, inexpensive, and environmentally-benign boron compounds which, when added to a fuel or lubricant, improve the lubricating properties of those fuels and lubricants. The addition of the boron compounds to a fuel improves the lubricity of the fuel by compensating for the lower lubricity that occurs when fuels with lower levels of sulfur are used.

The additives of the present invention can be any simple boron compound that dissolves in a common solvent to form a solution, which may be fully miscible with a diesel or gasoline fuel or a lubricant, to produce a concentration of boric acid molecules and/or $BO_3$ ions or monomers in the fuel or lubricant composition. Without intending to be bound to any particular theory, it is believed that solutionized boric acid molecules and negatively charged $BO_3$ monomers in the fuel or lubricant solutions bind strongly to the metallic surfaces of fuel pump and injector systems and protect these surfaces against wear and high-friction losses. Once bonded to these surfaces, the boric acid molecules and $BO_3$ ions are thought to rearrange themselves in a plate-like boric acid structure, providing an unusual capacity to enhance the anti-friction and anti-wear properties of sliding metallic surfaces. Tests show that boric acid films formed by dipping steel, aluminum, titanium, and magnesium surfaces in water or methanolic solutions of boric acid are strongly bonded to these surfaces, making them very slippery and resistant to wear. Such films provide excellent lubrication to these metals when subjected to metal forming operations (such as stamping, rolling, deep-drawing, and forging).

Since the most effective components for improving lubricity are boric acid molecules and $BO_3$ monomers or ions, any simple boron compound that generates boric acid molecules or $BO_3$ may be used to increase lubricity in low-sulfur fuels. Boron compounds that are known to release boric acid and/or $BO_3$ in water or alcohol solutions are: borax, kernite, ulexite, and colemanite. Other suitable boron compounds include boric acid, borax, boric oxide and other anhydrous or hydrated forms of boron. These compounds easily and readily form concentrated solutions in solvents such as methanol or ethanol. In addition, borates, boroxins, and combinations thereof can be mixed with solvents and fuels. For example, trimethylborate and trimethoxyboroxin are also ideal additives since they exist in liquid forms and are completely miscible with fuels.

Suitable fuels for use with the present methods for providing lubricity in a fuel include, but are not limited to diesel, gas, kerosene, dimethyl ether, liquid propane gas, liquid propane fuels, liquefied natural gas, or combinations of these. The fuels may also include a lubricant other than the boron compound such as those described herein.

Suitable lubricants for use with the present compositions and methods for providing lubricity in a lubricant include, but are not limited to, oil products such as base and formulated vegetable oils, mineral oils, synthetic oils, greases, and combinations thereof; polyethylene glycols and combinations thereof.

One embodiment of the method includes adding the boron compound or boric acid to a fuel to provide a boron-containing fuel that comprises boron compounds or boric acid at a level of from about 30 ppm to about 3,000 ppm. In various embodiments, the method provides a boron-containing fuel having a boron compound at a level of from about 200 to about 2000 ppm in the fuel, alternatively from about 50 ppm to about 1,000 ppm, or from about 100 ppm to about 500 ppm.

In some embodiments of the invention, a boron compound is added to a lubricant to provide a lubricant comprising a boron compound at a concentration of from about 100 ppm to about 80,00 ppm. In other embodiments, the amount of boron compound may vary from about 100 ppm to about 60,000 ppm, from about 100 ppm to about 50,000 ppm, and from about 500 or 1000 ppm to about 50,000 ppm.

Generally, the boron compounds or boric acid can be added to any fuel regardless of the sulfur content. In certain embodiments, the fuel has a sulfur concentration of less than about 500 ppm, possibly less than about 150 ppm, or even less than about 5 ppm, less than about 3 ppm, or even about 0 ppm. A fuel composition according to the invention, for example, includes a fuel having a sulfur content of less than about 500 ppm mixed with boric acid. The boric acid is typically present at a concentration of from about 100 ppm to about 3,000 ppm.

The invention also provides a method of powering an engine to minimize wear. The method includes burning a fuel which may have a sulfur content of less than about 500 ppm or less than about 150 ppm. The fuel includes a boron compound or boric acid at a concentration of from about 30 ppm and 3,000 ppm to the fuel. The boron compounds may be in the form of ionic compounds.

The lubricity of a given fuel can be determined through wear scar diameter measurements taken on a ball-on-three-disks (BOTD) instrument, as described in greater detail in the Examples section below. FIGS. 1 and 4-7 show the effects of the boron additives of this invention on the lubricity performance of diesel fuels, as measured by wear scar diameters. As shown in these figures, the average wear scar diameter for fuels treated with the boron compounds of this invention is approximately 3 to 4 mm when the fuel is tested according to the standard procedures described below. This is similar to the wear scar diameter produced with high-sulfur (500 ppm) diesel fuel and is considerably smaller than the wear scar diameters produced by untreated low-sulfur (150 ppm), ultra low-sulfur (3 ppm), and no sulfur (0 ppm) diesel fuels.

Figure 8:
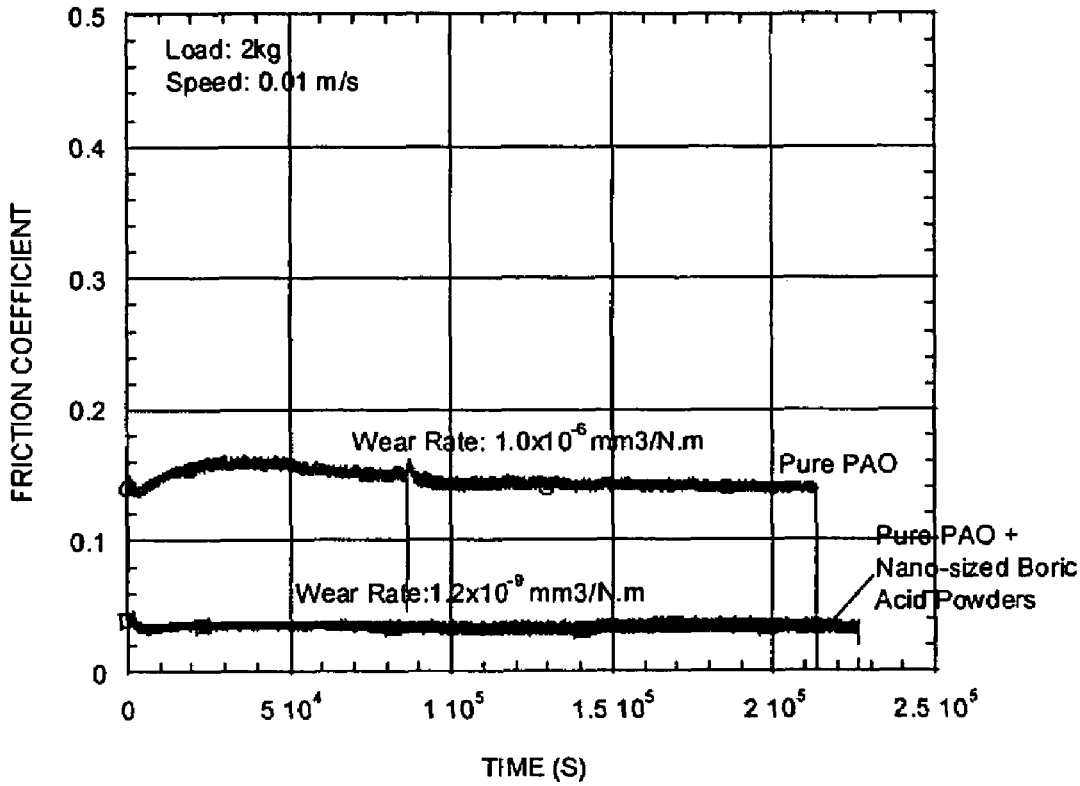
FIG. 8 is a graph showing the effect of nanometer-sized boric acid powders on the lubricity performance, as measured by the friction coefficient, of pure synthetic oil (Poly alpha olefin, PAO) with a steel pin and steel disk test pair under lubricated sliding conditions.
Figure 9:
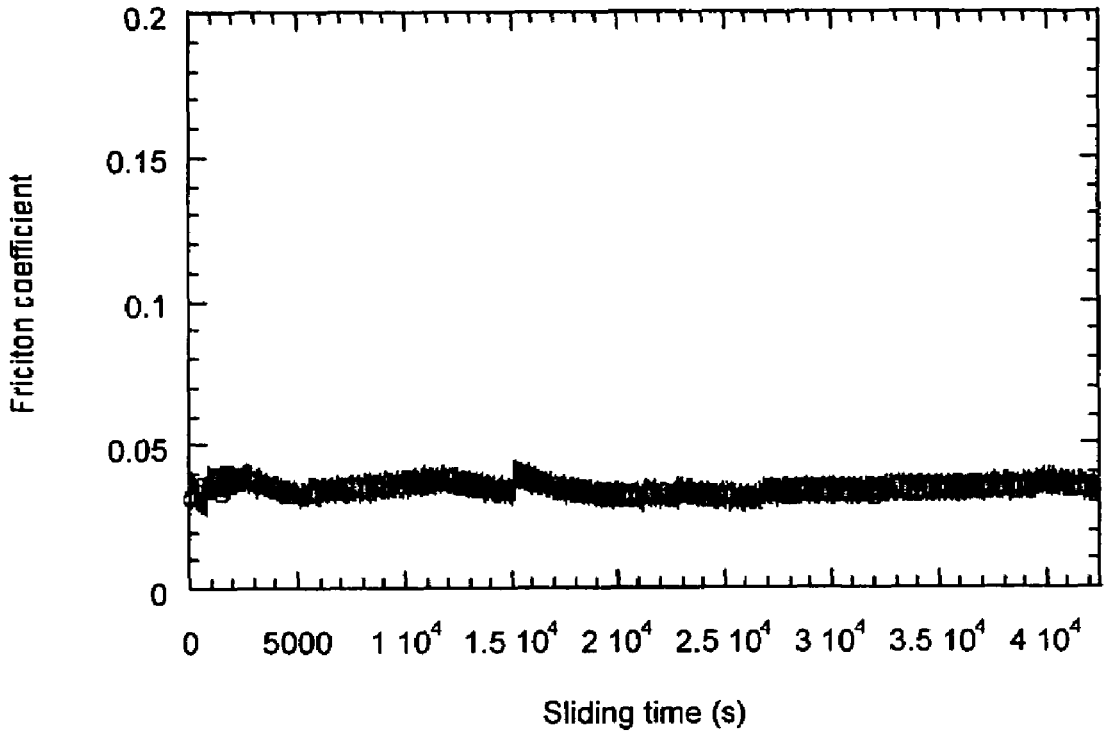
FIG. 9 is a graph showing the effect of nanometer-sized boric acid powders upon the lubricity performance, as measured by the friction coefficient, of paraffinic oil with a steel pin and magnesium alloy disk test pair under lubricated sliding conditions.
Figure 10:
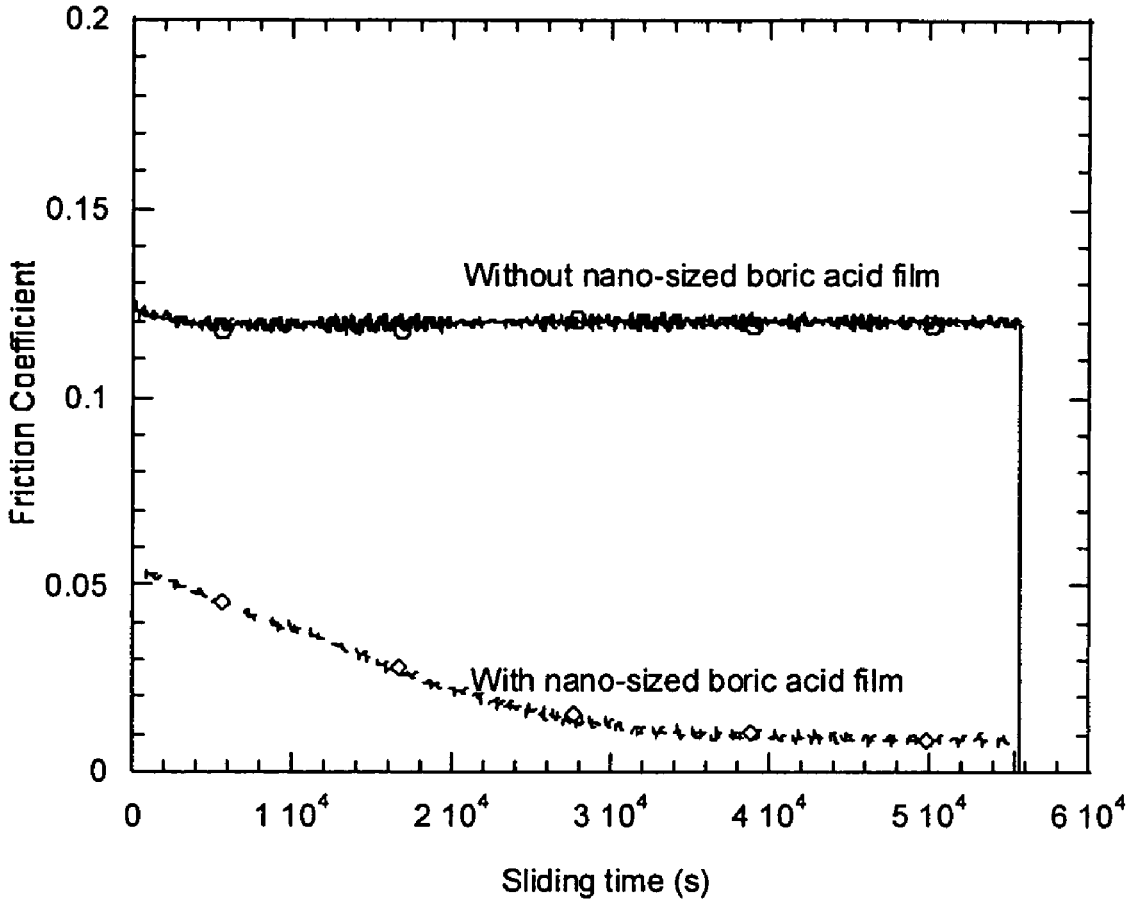
FIG. 10 is a graph showing the effect of a nano-structured boric acid coating upon the lubricity performance, as measured by the friction coefficient, of pure synthetic oil (PAO) with a steel pin and boron-carbide coated steel disk test pair under lubricated sliding conditions.

The lubricity of a given lubricant, such as an oil or grease, can be determined through friction coefficient measurements taken on a pin-on-disk instrument, as described in greater detail in the Examples section below. FIGS. 8-10 and table 5 show the effects of the boron additives of this invention on the lubricity performance of various oil products, as measured by friction coefficients. As shown in the figures and table, the friction coefficients for lubricants treated with boron additives are lower than those for untreated lubricants. This is consistent with improved lubricity performance for the treated lubricants.

In certain embodiments, the inventive additives are prepared in the form of concentrated solutions of simple, readily available boron compounds such as boric acid, borax, boron oxide, boron anhydrides, hydrates and other such materials. Such solutions are easily mixed with sulfur-free or low-sulfur diesel and gasoline fuels. Among others, ethanol and methanol are particularly effective solvents, and are among the most suitable candidates for introducing boron into gasoline fuels. Other suitable solvents include, but are not limited to, isobutyl alcohol, isoamyl alcohol, n-propanol alcohol, 2-methylbutanol alcohol, glycerol, glycol, ethylene glycol, glycerin, pyridine, lactate esters (such as ethyl lactate) or combinations of these solvents.

Figure 3:
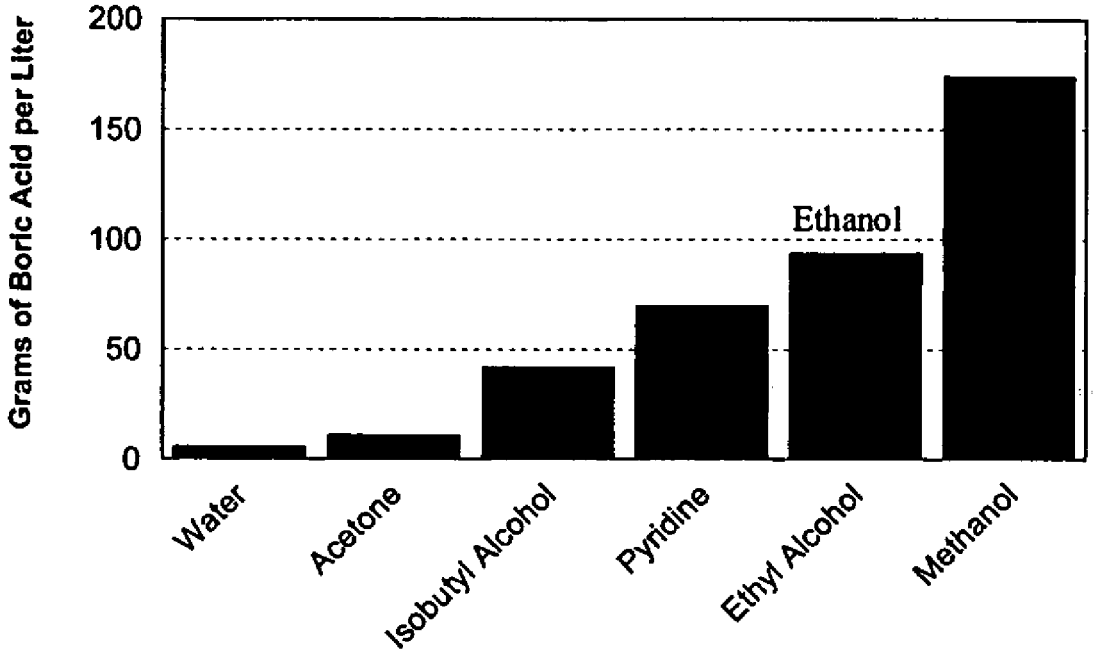
FIG. 3 is a bar graph showing the solubility of boric acid in various solvents.

In one embodiment, the inventive method exploits the fact that boric acid dissolves in an ethanol or methanol solution in great quantities such that the solvents can be used as a carrier of boron as a lubricity additive. Boric acid is most soluble in methanol, approximately 175 grams of boric acid dissolve readily in one liter of solvent. Lower solubilities are found in ethanol, pyridine, isobutyl alcohol, acetone, and water. The solubility of boric acid in these solvents is shown in FIG. 3. Boric acid is an attractive additive because it is a very mild, non-toxic acid that is environmentally benign—water solutions of boric acid are often used to wash eyes. Concentrated water solutions of boric acid have a pH value of 4.5 at room temperature. Boric acid is not expected to cause any corrosion in the fuel delivery systems. Indeed, in certain corrosion experiments, boric acid has been used as a buffer solution to control and adjust pH.

Figure 4:
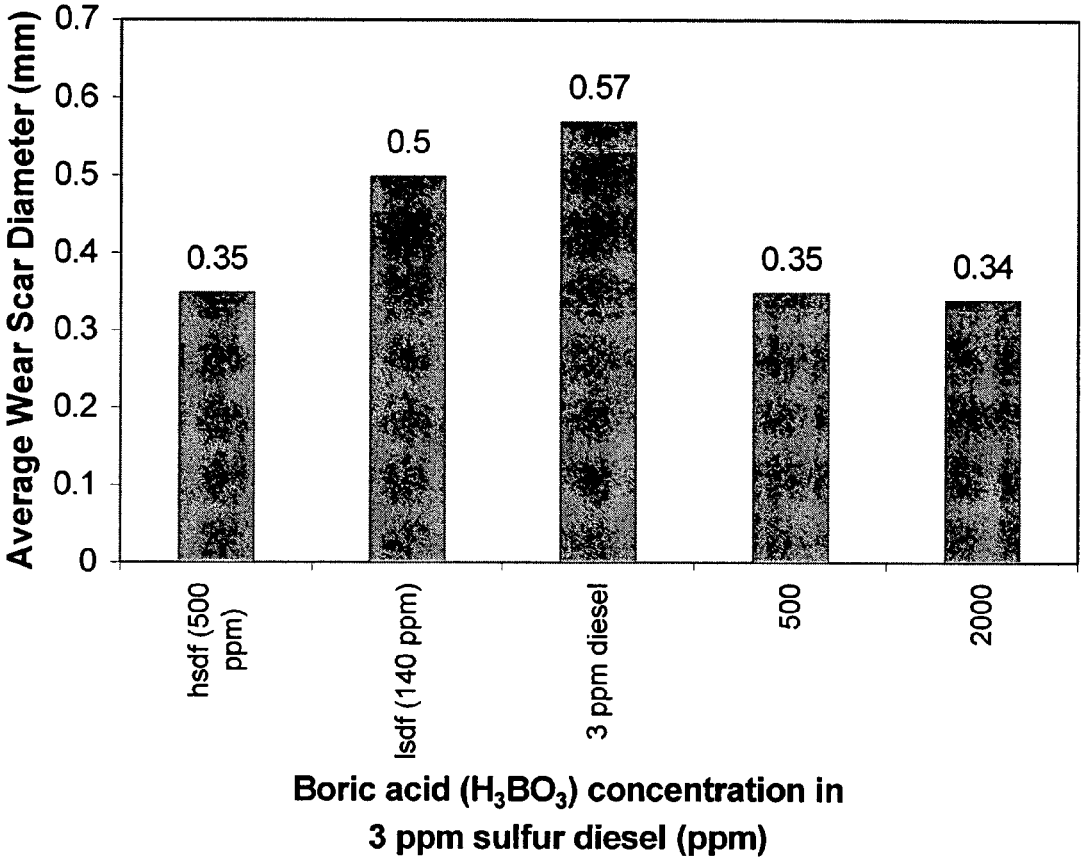
FIG. 4 is a bar graph showing the effects of boric acid on the lubricity performance, as measured by the wear scar diameter according to standard conditions described herein, of ultra low-sulfur (3 ppm sulfur content) diesel fuel.

FIG. 1 shows the effect of a highly concentrated (18%) methanolic solution of boric acid when mixed with low-sulfur diesel fuel (140 ppm). FIG. 4 shows the effect of a highly concentrated methanolic solution of boric acid when mixed with ultra low-sulfur diesel fuel (3 ppm). As shown in the figures, low and ultra low-sulfur diesel fuels containing between 100 and 2000 ppm boric acid have a lubricity performance comparable to high-sulfur diesel fuel, which is substantially better than the lubricity performance of untreated, low and ultra low-sulfur diesel fuels. Methanol and ethanol-based solvents are produced from cornstalks in the Midwest by Archer Daniels Midland. These solvents are already used with current gasoline in diesel fuels up to a level of 10%, but the United States government is urging their use in much greater quantities since methanol and ethanol are renewable non-polluting fuels. If necessary, the solubility of the boron compounds in these alcohols can be increased by heating them, but the concentrations achieved at room temperature are more than sufficient to restore the lubricity of low-sulfur diesel fuels.

Figure 5:
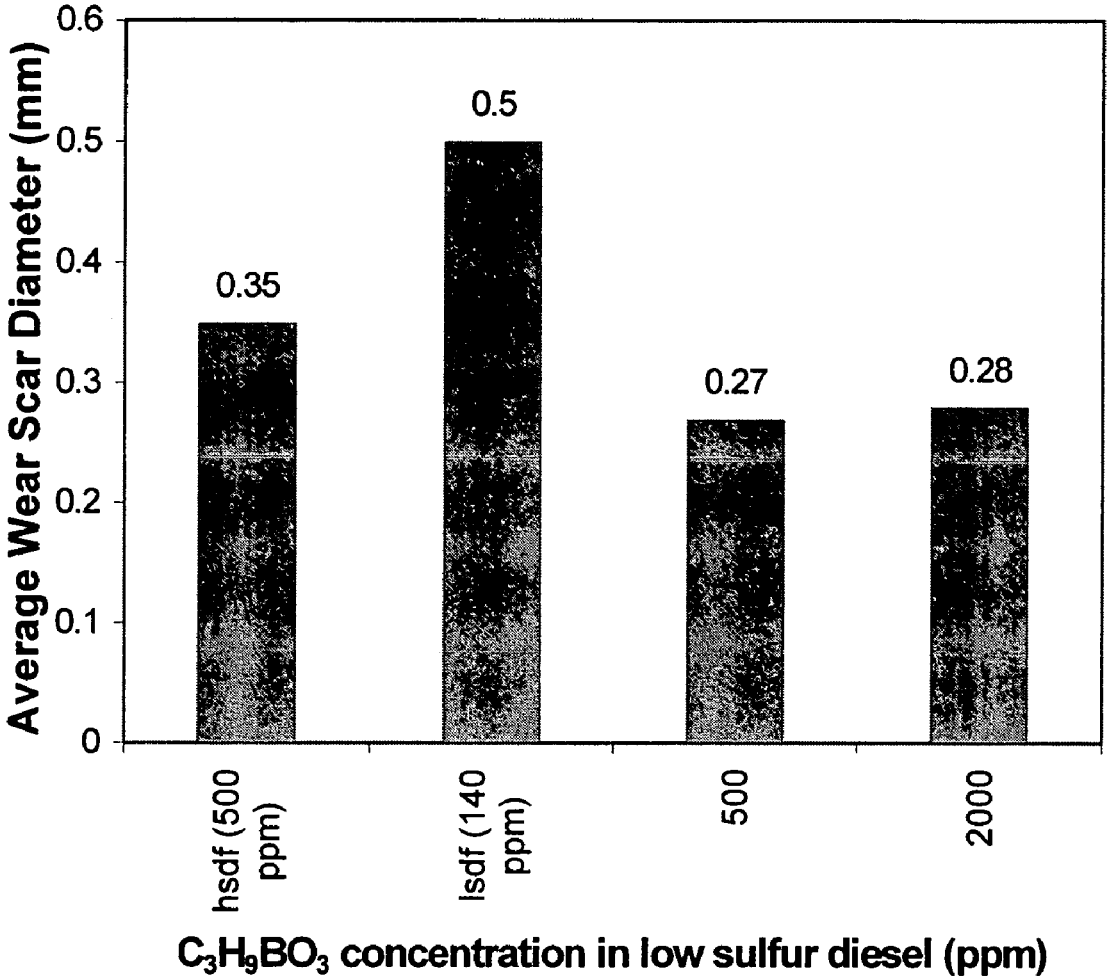
FIG. 5 is a bar graph showing the effects of trimethylborate on the lubricity performance, as measured by the wear scar diameter according to standard conditions described herein, of low-sulfur (140 ppm sulfur content) diesel fuel.

Another effective way to achieve lubricity in low-sulfur diesel fuels and in lubricants is to add to the fuel or lubricant a borate, boroxin or combination thereof. Suitable borates include trialkylborates such as trimethylborate, and suitable boroxins include trimethylboroxin, trimethoxyboroxin, and tributoxyboroxin. These commercial products come in liquid forms. They are clear and transparent and mix and blend quite well with gasoline or diesel fuels. They burn clean and have some calorific value. They are perfectly soluble in diesel and gasoline fuels and, once added to diesel fuel, dramatically improve the lubricity of low-sulfur diesel fuels. Thus, trimethylborate and trimethoxyboroxin may be added directly to the fuel. For example, as shown in FIG. 5, trimethylborate provides the best improvement of the lubricity behavior of low-sulfur diesel fuels of all the boron additives tested. Notably, FIG. 5 shows that low-sulfur fuels to which trimethylborate has been added exhibit an average wear scar diameter even lower than that of the highest sulfur content diesel fuel. As shown in FIGS. 6(*a*) and (*b*), addition of trimethoxyboroxin into no sulfur (0 ppm) and low-sulfur (140 ppm) diesel fuels also makes a huge positive difference in fuel's lubricity. Other trialkylborates may also be used to improve lubricity in fuels. Examples of such trialkylborates include, but are not limited to, triethylborate, tri(n-propyl)borate, tri(n-butyl)borate, and mixed alkyl borates such as diethylmethylborate.

In other embodiments of the invention, nanometer size powders of solid boron compounds, such as boric acid, may be solutionized or dispersed in fuels and oil products to achieve improved lubricity. Nanometer-sized particles of boron compounds may also be mixed and fully dispersed in or miscible with fuels and oil products to achieve lubricity.

Nanometer-sized powders of boric acid (3-100 nm) can be produced by methods well known in the art. These methods include mechanical attrition, chemical precipitation, low pressure gas condensation and low temperature evaporation of ethyl borates or methanol or ethanol solutions of boric acid into or through the fuels or oils, etc. Because of a very high surface atom to bulk atom ratio, these nanometer-sized boron or boric acid particles can directly be incorporated into fuel and oil products such as base and formulated vegetable, mineral, and synthetic oils, greases and combinations thereof.

Figure 7:
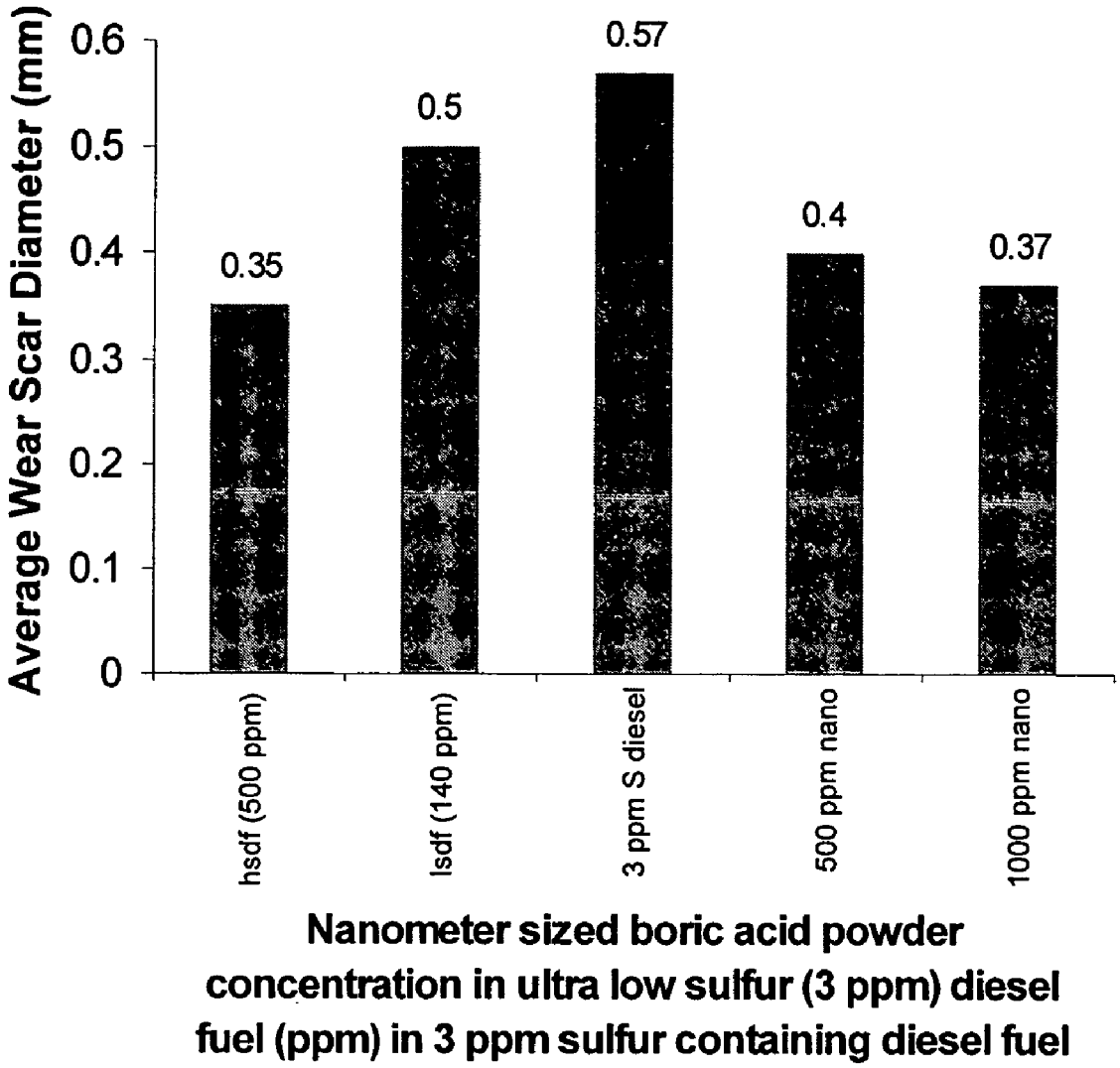
FIG. 7 is a bar graph showing the effects of nanometer-sized boric acid powders on the lubricity performance, as measured by the wear scar diameter according to standard conditions described herein, of ultra low-sulfur (3 ppm sulfur content) diesel fuel.

Most of the atoms in these nanometer-sized particles reside on the surface of the particles and they are chemically very active. With very high surface energy, they are both physically and chemically attracted to the hydrocarbon molecules in fuels and oils. At such very low concentrations as 50 to 1000 ppm, they remain uniformly dispersed in fuels and act as self-lubricating entities. Such nanometer-sized particles may also be mixed or blended with lubricants such as oils, greases or combinations thereof; or polyethylene glycols, and combinations thereof, to achieve improved lubrication and superior anti-friction and wear properties in these products. FIG. 7 shows the lubricity performance of diesel fuels containing nanometer-sized boric acid powders in dispersion. It can be seen from the figure that treating ultra low-sulfur (3 ppm) diesel fuels with between about 500 and 1000 ppm nanometer-sized boric acid powders increases the lubricity performance of the fuel compared to untreated low and ultra low diesel fuels. In fact, as shown in the figure, the treated ultra low-sulfur fuels have a lubricity performance comparable to that of untreated high-sulfur diesel fuels. FIGS. 8, 9, and 10 show the lubricity performance, as measured by friction coefficients, of nanometer-sized boric acid powders mixed with various oils on steel and magnesium alloys. In these figures, lubricity performance is determined through friction coefficient measurements taken with a pin-on-disk instrument, as described in more detail in the Examples section below. Briefly, FIGS. 8-10 show that adding nanometer-sized boric acid powders to synthetic and paraffinic oils leads to a decrease in the friction coefficient, which corresponds to an increase in the lubricity performance of the oils.

The invention is further described in the following non-limiting examples.

EXAMPLES

Preparation of Test Fuels and Oils Containing Boron Additives

Various fuels and oils were tested for lubricity by measurement of wear scar diameters and friction coefficients. These fuels were obtained by adding concentrated solutions of boron compounds to the fuel in quantities sufficient to provide a concentration of boron, boric acid and/or $BO_3$ monomers of between 100 ppm and 2000 ppm in the fuel composition. Similarly, oils were obtained by adding concentrated solutions of boron compounds to the oils in quantities sufficient to provide a concentration of boron, boric acid, and/or $BO_3$ monomers of up to 8 percent by volume. In certain embodiments the boron compounds were present in an amount of between 0.1 and 8 percent by volume.

Figure 2A:
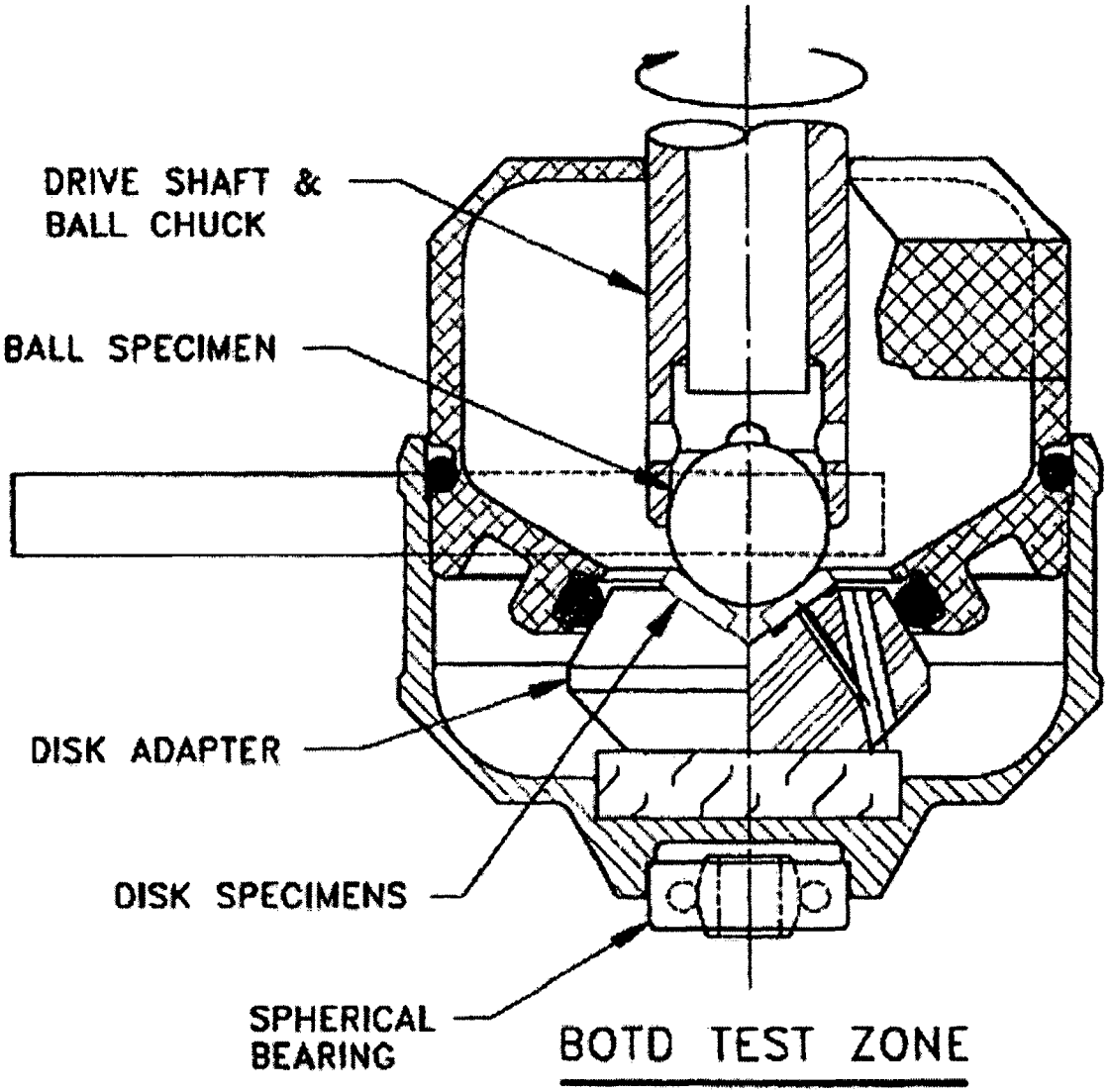
FIG. 2*a*. is a cut-away side view diagram showing the (ball-on-three-disk) BOTD Fuel Lubricity Test Machine, and the standard conditions used for testing fuel lubricity, as described herein.

Fuel Wear Testing Protocol:

Lubricity additives were evaluated using wear scar diameter measurements. Friction and wear measurements were carried out using a ball-on-three-disk (BOTD) Fuel Lubricity Test Machine according to the standard conditions described below, and as shown in FIG. 2*a*. The data obtained with this testing apparatus under standard testing conditions show the improvement in diesel fuel lubricity that occurs when boron compounds such as boric acid are added to the fuel.

Diesel fuel lubricity tests were conducted in a BOTD lubricity test machine whose detailed description can be found in C. D. Gray, G. D. Webster, R. M. Voitik, P. S T Pierre, and K. Michell, "Falex Ball-on-Three Disk (BOTD-M2) Used to Determine the Low Temperature Lubricity and Associated Characteristics of Lubricity Additives for Diesel Fuels," Proc. 2$^{nd}$ Int. Colloquium on Fuels, W. J. Bartz, ed., Technische Akademie Esslingen, Ostfildem, Germany, pp. 211-217 (1999), which is herein incorporated by reference. In brief, the test configuration for the BOTD machine consists of a highly polished 12.7-mm-diameter alumina ball ($Al_2O_3$) pressed against three stationary 52100 grade steel flats under a load of 24.5 N, creating a peak Hertz pressure of about 1 GPa. The steel disks were 6.35 mm in diameter and had a surface finish between 0.1 and 0.2 μm, root mean square. The Rockwell C hardness value of the steel disks was 57 to 63. The lubricant cup of the BOTD machine was filled with the diesel fuels, and the rubbing surfaces of the steel specimens were immersed in fuel throughout the tests. Rotational velocity of the ceramic ball was 60 rpm and the test duration was 45 min. At the conclusion of each test, the dimensions of the wear scars on the flat steel specimens were measured by an optical microscope equipped with a digital micrometer display unit. The average wear scar diameters are expressed in mm. In terms of fuel lubricity and wear analyses, this is presently the most widely used procedure to assess the lubricity of diesel fuels.

The BOTD Lubricity Test Machine shown in FIG. 2*a* was developed to evaluate the anti-wear performance of diesel fuels. The amount of wear achieved was measured during point to point contact of the test ball specimen under high load and rotational speed with each test diesel fuel as the lubricant. Average wear scar diameter on the flat 52100 test steel was measured in control fuels (respectively, high-sulfur diesel fuel containing 500 ppm sulfur, and low-sulfur diesel fuel containing 140 ppm) that did not contain any boron additive. The effect on average wear scar diameter of various boron additives according to the present invention was then measured in low-sulfur diesel fuel (0-140 ppm sulfur content), the test fuel having boron and/or boron compound concentrations of between 100 and 2000 ppm.

When standard lubricity tests are performed on a diesel fuel having a sulfur content of from about 400 to about 800 ppm, the typical wear scar diameter forming on a flat 52100 steel is around 0.35 mm. The data for untreated fuels appears in tables 1-4. The data show that Fischer Tropsch fuel (sulfur content of approximately zero) has the highest wear index of 0.75 mm scar diameter. Ultra low-sulfur fuel (3 ppm sulfur content) has a wear index of 0.57 mm. Low-sulfur diesel fuel (140 ppm sulfur content) has a wear scar index of 0.49 mm. Finally, high-sulfur diesel fuel, (500 ppm sulfur content) has the lowest wear index of 0.35 mm.

The change in lubricity and increase in wear was measured for fuels treated with various boron compounds. The data for these treated fuels appears in tables 1-4. The results demonstrate that diesel fuels of very low-sulfur content (140 ppm or lower sulfur content) with boric acid additive exhibited smaller wear scar diameters (in one case less than 0.28 mm) than did untreated fuels having the highest sulfur content (0.35 mm or greater wear scar diameter). It was concluded that low-sulfur fuels containing the boron additives of the present invention have increased lubricity compared to untreated high-sulfur fuels (500 ppm sulfur content).

The effect of boric acid on low-sulfur diesel is dramatic. Table 1 lists the changes in the wear scar diameter for different boric acid concentrations in low-sulfur diesel fuel. The effect upon average wear scar diameter of low-sulfur diesel fuel (having a sulfur content of 140 ppm) when an 18% concentrated methanol solution of boric acid is added to low-sulfur diesel fuel is shown in the table. The addition of the boron compound to the low-sulfur diesel fuel results in a dramatic increase in lubricity as indicated by the lower wear scar diameter.

TABLE 1

Effect of highly concentrated methanolic solution of boric acid (18% boric acid in methanol) on anti-wear properties of low-sulfur diesel fuel (140 ppm sulfur content).

| Boric Acid ($H_3BO_3$) Concentration in Low-Sulfur Diesel (ppm) | Wear Scar Diameter (mm) |
|---|---|
| 0 | 0.498 ± 0.043 |
| 100 | 0.336 ± 0.011 |
| 250 | 0.284 ± 0.068 |
| 500 | 0.297 ± 0.065 |
| 1,000 | 0.296 ± 0.038 |
| 2,000 | 0.348 ± 0.072 |

FIG. 1 illustrates these values graphically, showing the effect on lubricity performance of a variation in boron concentration in the fuel between 100 ppm ($3^{rd}$ bar) and 2000 ppm ($7^{th}$ bar). Average wear scar diameters for two control fuels, high-sulfur diesel fuel (500 ppm) and low-sulfur diesel fuel (140 ppm), are shown by bars 1 and 2. It is evident from the graph that more lubricity is provided to low-sulfur diesel fuel (140 ppm) by adding methanol solutions of boric acid, than is conferred to diesel fuel by 500 ppm sulfur content.

Table 2 shows the changes in the wear scar diameter for different concentrations of highly concentrated methanol solutions of boric acid (18%) in ultra low-sulfur diesel fuel (3 ppm sulfur content).

TABLE 2

Effect of highly concentrated methanolic solution of boric acid (18% boric acid in methanol) on anti-wear properties of ultra low-sulfur diesel fuel (3 ppm sulfur content).

| Boric Acid ($H_3BO_3$) Concentration in Ultra Low-Sulfur Diesel (ppm) | Wear Scar Diameter (mm) |
|---|---|
| 0 | 0.571 ± 0.008 |
| 500 | 0.356 ± 0.020 |
| 2000 | 0.346 ± 0.023 |

FIG. 4 illustrates these values graphically. This figure shows the effect of methanolic solution of boric acid upon the lubrication performance of 3 ppm sulfur containing diesel fuel. The graph shows that 500 ppm boric acid provides approximately the same lubricity as that found in standard high-sulfur diesel fuel. Bars 4 and 5 of the graph show the effect that addition of boron (500 ppm and 2,000 ppm boric acid content respectively) has upon average wear scar diameter of ultra low-sulfur diesel fuel. Bars 1, 2 and 3 show lubricity in three control fuels, respectively high-sulfur diesel fuel (500 ppm), low-sulfur diesel fuel (140 ppm), and ultra low-sulfur diesel fuel (3 ppm). Average wear scar diameter is the highest in the ultra low-sulfur diesel fuel without boron.

Table 3 lists the changes in the wear scar diameter exhibited for different concentrations of trimethylborate in low-sulfur diesel fuel (140 ppm sulfur content).

TABLE 3

Effect of trimethylborate on the anti-wear properties of low-sulfur diesel fuel (140 ppm sulfur content).

| Trimethylborate Concentration in Low-sulfur Diesel (ppm) | Wear scar diameter (mm) |
|---|---|
| 0 | 0.498 ± 0.043 |
| 500 | 0.266 ± 0.020 |
| 2,000 | 0.286 ± 0.042 |

FIG. 5 illustrates these values graphically. The bar graph in the figure shows the effect of addition of trimethylborate to low-sulfur diesel fuel (140 ppm), demonstrating a lower average wear scar diameter than in the control fuels containing no borate. Both controls, high-sulfur diesel fuel (500 ppm) (bar 1) and low sulfur diesel fuel (140 ppm) (bar 2), show a higher wear index than the lower sulfur containing fuel with boron present. Low-sulfur diesel fuel (140 ppm) (bar 2) without boron has the greatest wear index, as expected.

Table 4 lists the changes in the wear scar diameter when trimethoxyboroxin is added to a sulfur free diesel fuel (Fischer Tropsch, 0 ppm) and a low-sulfur diesel fuel (140 ppm).

TABLE 4

Effect of trimethoxyboroxin on the anti-wear properties of Fischer Tropsch diesel fuel (0 ppm sulfur content) and low-sulfur diesel fuel (140 ppm sulfur content).

| Trimethoxyboroxin Concentration (ppm) in fuels | Wear scar diameter (mm) for Fischer Tropsch fuel | Wear scar diameter (mm) for low-sulfur diesel fuel |
|---|---|---|
| 0 | 0.75 ± 0.008 | 0.498 ± 0.004 |
| 250 | 0.405 ± 0.004 | 0.395 ± 0.007 |
| 500 | 0.370 ± 0.006 | 0.359 ± 0.008 |
| 1000 | 0.362 ± 0.008 | 0.345 ± 0.005 |

Figure 6A:
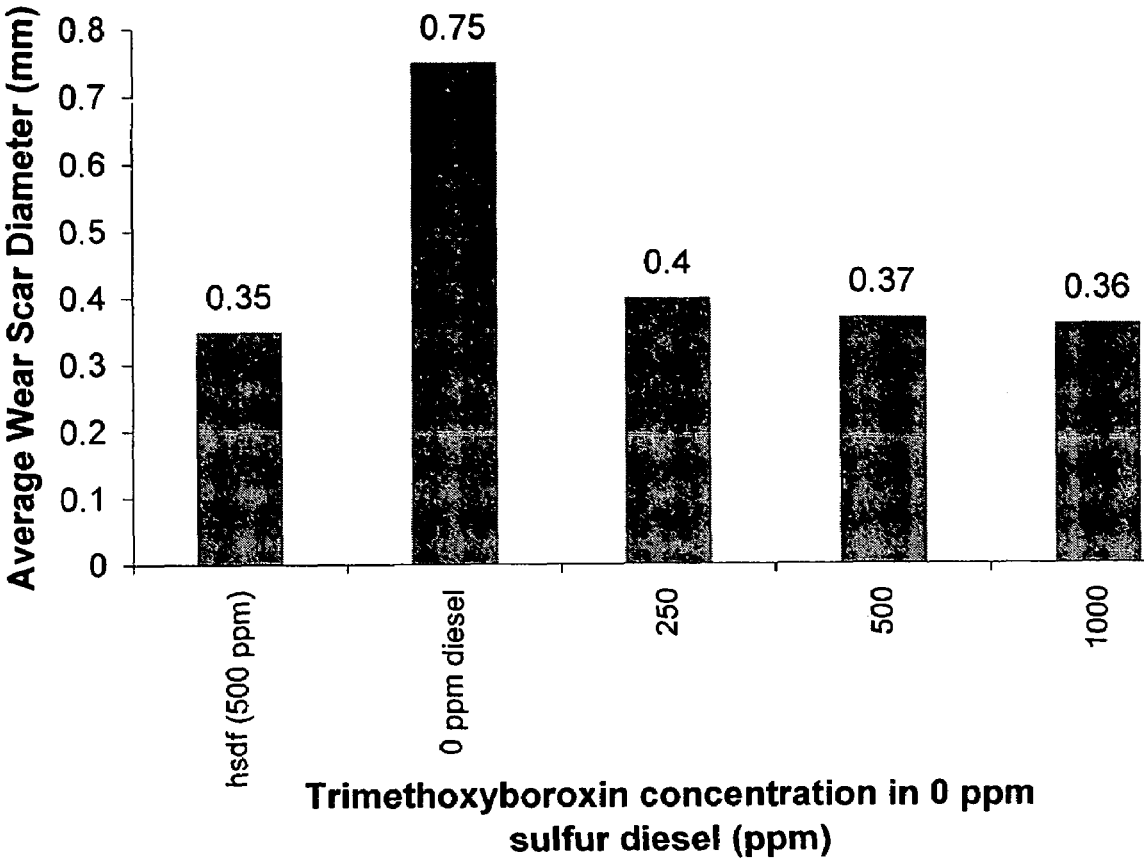
FIG. 6 is a bar graph showing the effects of trimethoxyboroxin on the lubricity performance, as measured by the wear scar diameter according to standard conditions described herein, of no sulfur (0 ppm sulfur content) and low-sulfur (140 ppm sulfur content) diesel fuels.
Figure 6B:
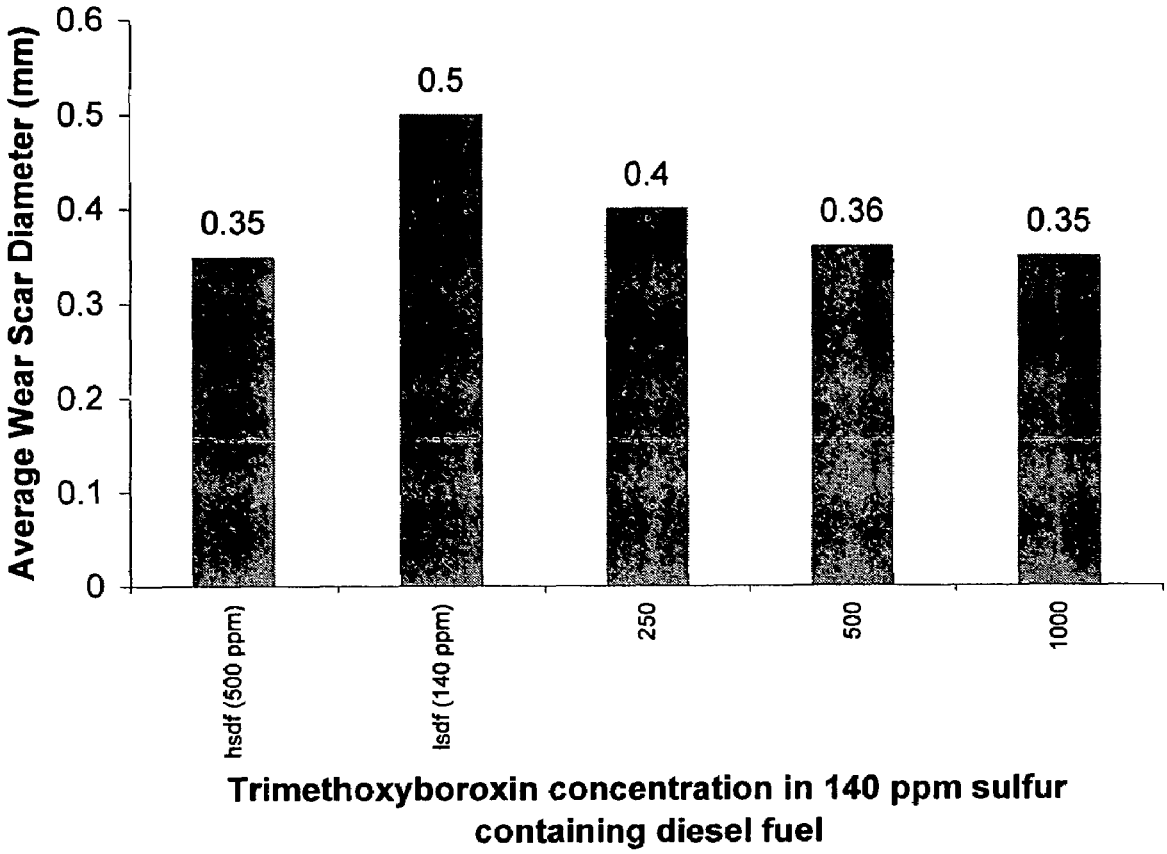

FIG. 6 graphically represents the effect upon the fuel wear scar diameter of the addition of trimethoxyboroxin to a sulfur free diesel fuel (FIG. 6*a*) and a low-sulfur diesel fuel (FIG. 6*b*), in the amounts respectively of 250, 500, and 1000 ppm. The first two bars in FIG. 6*a* represent the average wear scar diameter for control diesel fuels having a sulfur content of 500 ppm and 0 ppm, respectively. Similarly, the first two bars in FIG. 6*b* represent the average wear scar diameter for control diesel fuels having a sulfur content of 500 ppm and 140 ppm, respectively. FIGS. 6*a* and 6*b* both show that the addition of trimethoxyboroxin at a concentration of between 250 and 1000 ppm results in a lowering of the average wear scar diameter.

FIG. 7 graphically represents the effect of nanometer-sized boric acid powders on the lubricity performance of 3 ppm sulfur containing diesel fuel. The nanometer-sized powders of boric acid (3-100 nm) were produced by low pressure gas condensation and low temperature evaporation of ethyl borates or methanol or ethanol solutions of boric acid into or through the fuels or oils. The first three bars in FIG. 7 represent the average wear scar diameter for control diesel fuels having a sulfur content of 500 ppm, 140 ppm, and 3 ppm, respectively. The remaining two bars show that the addition of nanometer-sized boric acid powders at concentrations between about 250 and about 1000 ppm results in a lowering of the average wear scar diameter.

Lubricant Friction Coefficient Testing Protocol:

In addition to evaluating diesel fuels using wear scar diameter measurements, lubricants were evaluated using friction coefficient measurements. Friction coefficient measurements were carried out using a pin-on-disk Test Machine according to the standard conditions described below. The testing apparatus and standard testing conditions show the improvement in lubricant lubricity that occurs when boron compounds such as boric acid are added to lubricants, such as oils and greases.

Figure 2B:
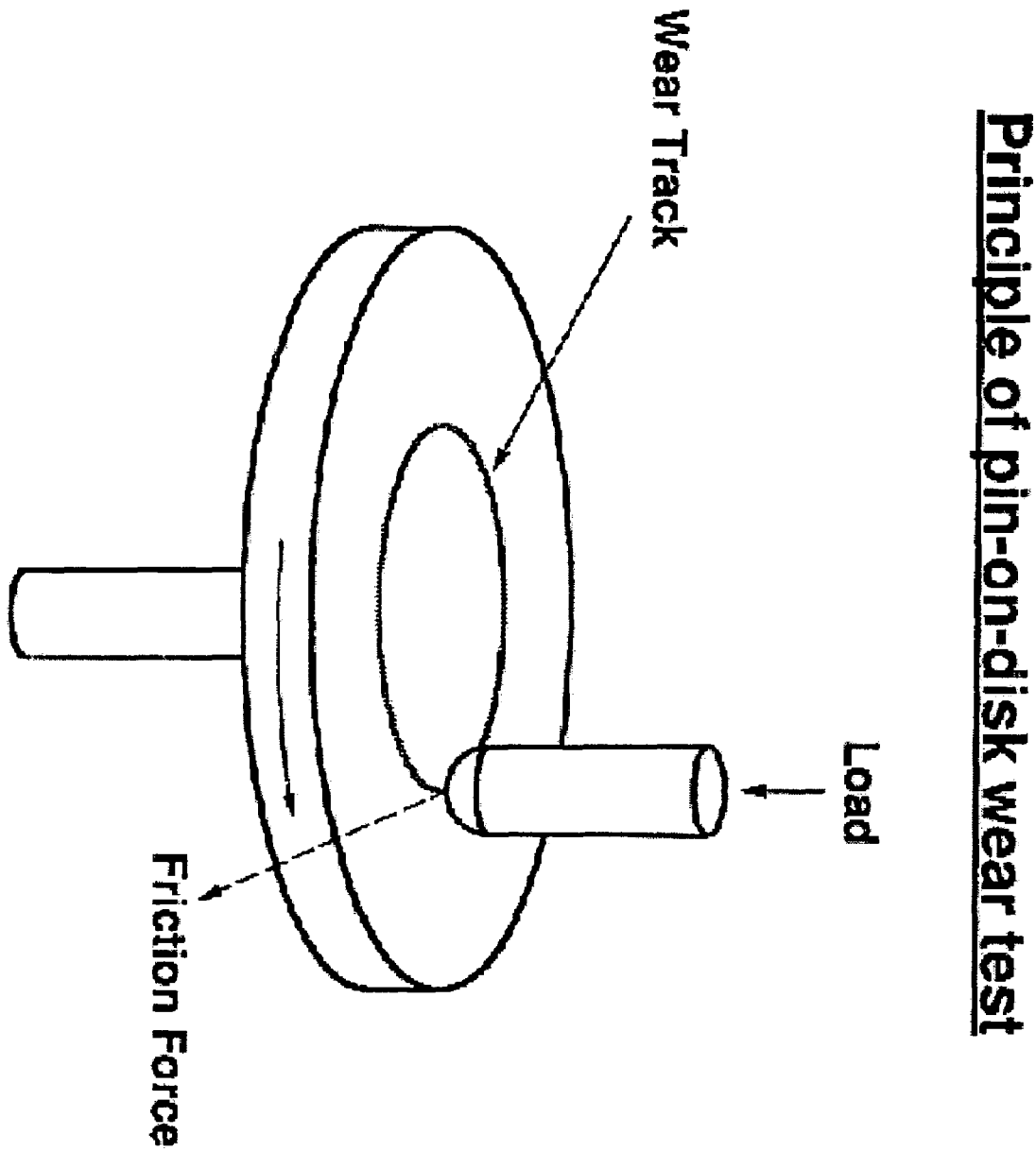
FIG. 2*b*. is a diagram showing a pin-on-disk machine, as described herein.

Diesel fuel lubricity tests were conducted in a pin-on-disk test machine whose detailed description can be found in the 1990 Annual Book of ASTM Standards, Volume 3.02, pages 391-395, which is herein incorporated by reference. In brief, the machine consists of a stationary top-mounted pin that rubs against a unidirectional rotating disk or flat. The pins can be either flat pins, hemispherically tipped pins (typically, the pins that have a 5" radius ground onto one of the faces). Alternatively, ⅜" or ½" diameter balls can be used. Disks up to approximately 3" in diameter (approximately ¼" thick) can be tested on the machine. The chuck that holds the discs can also hold flats up to 2"×2". The lubricants are applied to the disk surface, and the pins are rubbed against the disk. A load is applied to the pin by using dead weights. For the specific tests performed, 20 to 50 N loads were used and the sliding velocity of the rotating disk was adjusted to give linear velocities of 0.01 and 0.1 m/s. Tests were run at room temperature and in open air whose relative humidity varied between 30 and 60%. A schematic of this test system can be found in FIG. 2*b*.

FIG. 8 is a graph showing the effect upon the lubricity performance of nanometer-sized boric acid powders, which were sprayed on the surface of a steel disk, to pure synthetic oil (PAO).

FIG. 9 is a graph showing the effect of nanometer-sized boric acid powders, which were sprayed on the surface of a steel disk, upon the lubricity performance of a paraffinic oil on a magnesium alloy sample.

FIG. 10 is a graph showing the effect of a nano-structured boric acid coating mixed with PAO upon the lubricity performance of a steel pin and boron-carbide coated steel disk test pair under lubricated sliding conditions. These coatings are prepared by either spraying of methanolic solutions of boric acid to the surface or chemically extracting them from the boron carbide coatings by a high temperature chemical conversion method as described in U.S. Pat. No. 5,840,132, which is herein incorporated by reference.

As shown in FIGS. 8-10, the presence of nanometer-sized boric acid powders on a sliding surface significantly reduces the friction coefficient of the oil.

Table 5 shows the changes in lubricity performance, as measured by both wear scar diameters and friction coefficients, for various test pairs when trimethoxyboroxin is added to a base mineral oil. The data in table 5 demonstrate that the addition of trimethoxyboroxin (5 percent by volume) to pure mineral oil dramatically decreases the friction coefficient and the wear scar diameter, which corresponds to an improvement in the lubricity performance of the oil.

TABLE 5

Effect of 5 vol. % trimethoxyboroxin addition to the anti-wear properties of a pure mineral oil. This test was performed on a pin-on disk machine whose function and main features may be found in the 1990 Annual Book of ASTM Standards, Volume 3.02, Section 3, pages 391-395.

| | Wear scar diameters (WSD) (mm) and friction coefficients (FC) with pure mineral oil | | Wear scar diameters (WSD) (mm) and friction coefficients (FC) with mineral oil + 5 vol. % trimethoxyboroxin | |
|---|---|---|---|---|
| Test Pairs | WSD | FC[a] | WSD | FC[a] |
| Steel pin/Steel disk[b] | 0.454 | 0.05 | Non-measurable | 0.01 |
| Steel pin/Steel disk[c] | 1.11 | 0.06 | Non-measurable | 0.01 |
| Steel pin/Steel disk[d] | 1.695 | 0.2 | Non-measurable | 0.02 |
| Steel ball/Steel disk[e] | 0.67 | 0.14 | 0.43 | 0.085 |
| Steel pin/titanium disk[f] | 2.564 | 0.35 | 1.998 | 0.15 |
| Steel pin/aluminum disk[g] | 3.778 | 0.16 | 2.035 | 0.13 |

[a]Steady state friction coefficients
[b]Test Conditions: 2 kg load, 10 cm/s speed, using steel pin with 127 mm radius of curvature, sliding distance: 135 m.
[c]Test Conditions: 5 kg load, 10 cm/s speed, using steel pin with 127 mm radius of curvature, sliding distance: 135 m.
[d]Test Conditions: 2 kg load, 1 cm/s speed, using steel pin with 127 mm radius of curvature, sliding distance: 135 m, sliding distance: 375 m.
[e]Test Conditions: 2 kg load, 1 cm/s speed, using 10 mm diameter steel ball, instead of pin, sliding distance: 135 m.
[f]Test Conditions: 2 kg load, 10 cm/s speed, sliding distance: 135 m.
[g]Test Conditions: 5 kg load, 10 cm/s speed, sliding distance: 135 m.

Figure 11:
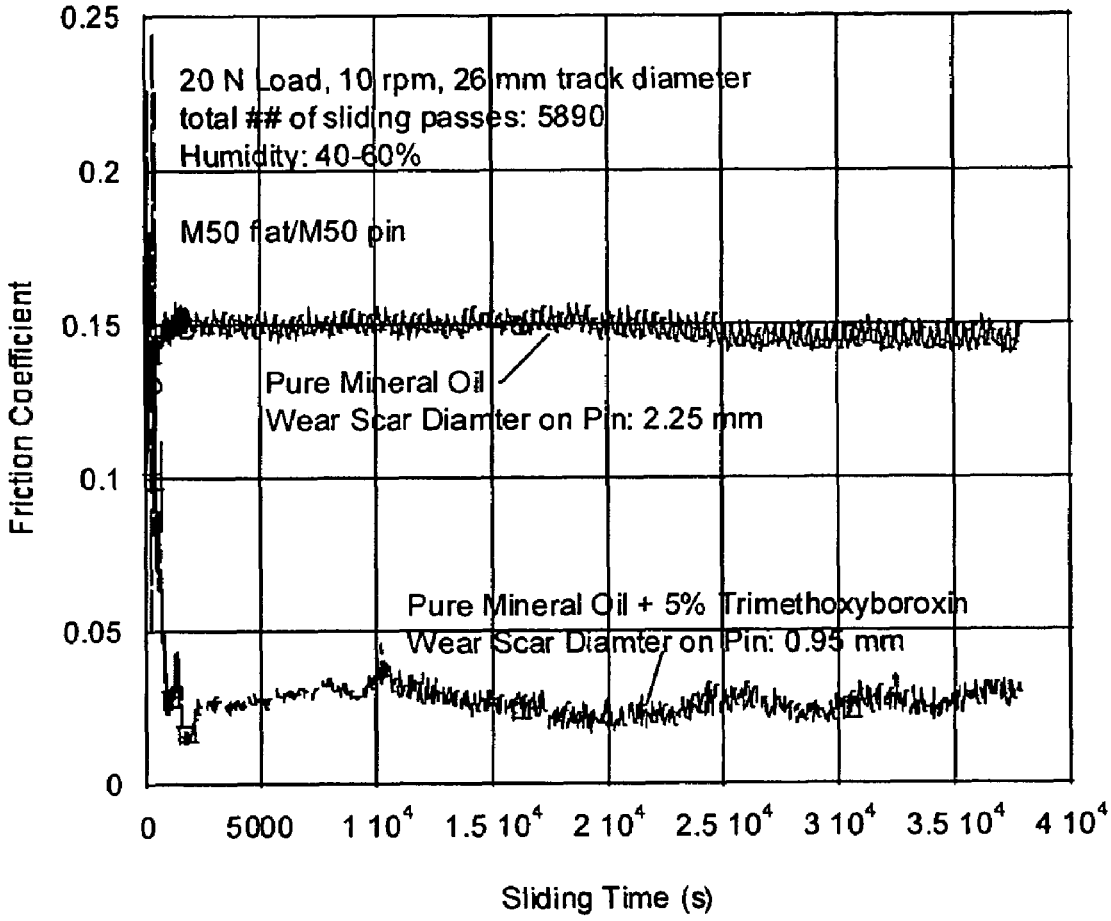
FIG. 11 is a graph showing the effect of a trimethoxyboroxin upon the lubricity performance, as measured by the friction coefficient, of pure synthetic oil (PAO) with a steel pin and steel disk test pair under lubricated sliding conditions.

FIG. 11 shows the some of the data from table 5 graphically. Specifically, FIG. 11 shows the actual frictional traces for a steel pin and a steel disk under the test conditions denoted by footnote "d" of the table, tested under 20 N using pure mineral oil and 5 vol. % trimethoxyboroxin containing mineral oil. The figure demonstrates that the presence of trimethoxyboroxin in the mineral oil significantly reduces the friction coefficient, consistent with improved lubricity performance of the oil.

Figure 12:
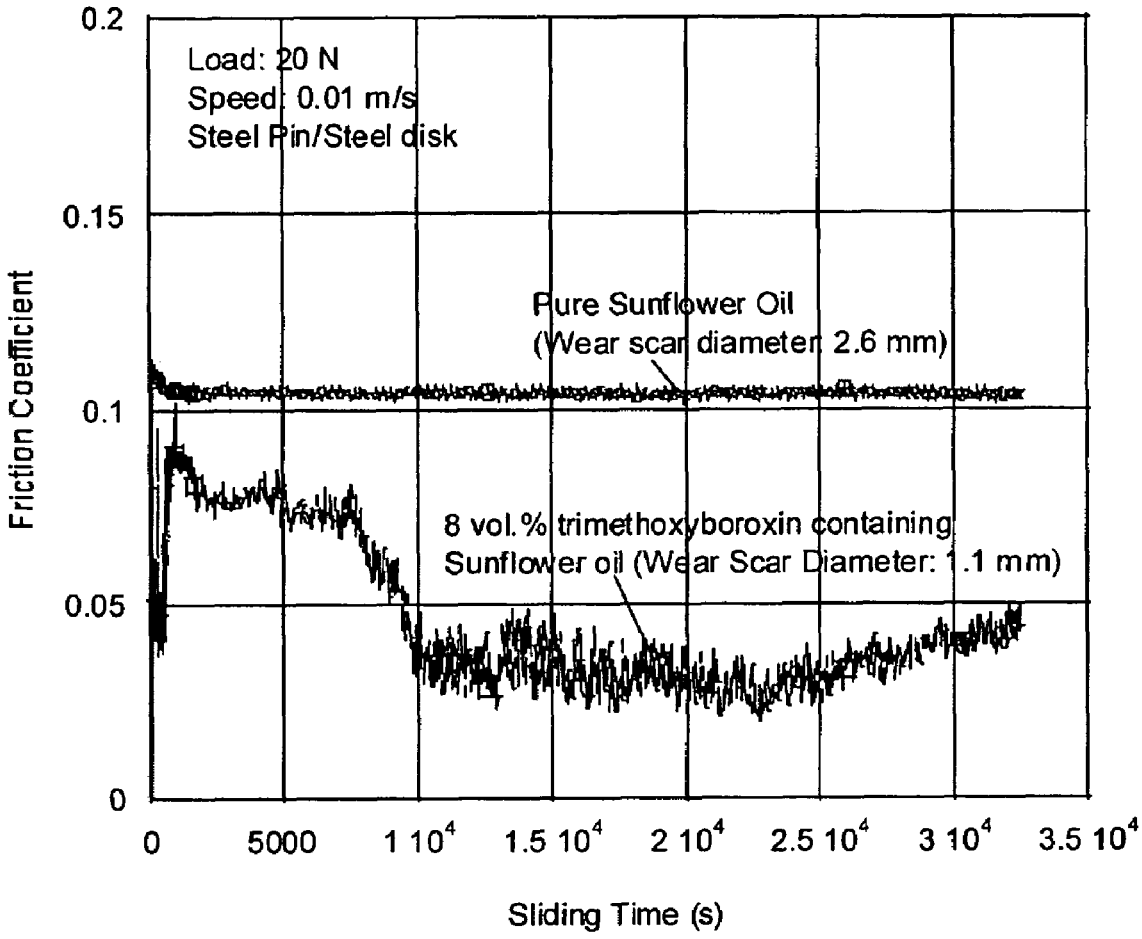
FIG. 12 is a graph showing the effect of a trimethoxyboroxin upon the lubricity performance, as measured by the friction coefficient, of sunflower oil with a steel pin and steel disk test pair under lubricated sliding conditions.
Figure 13:
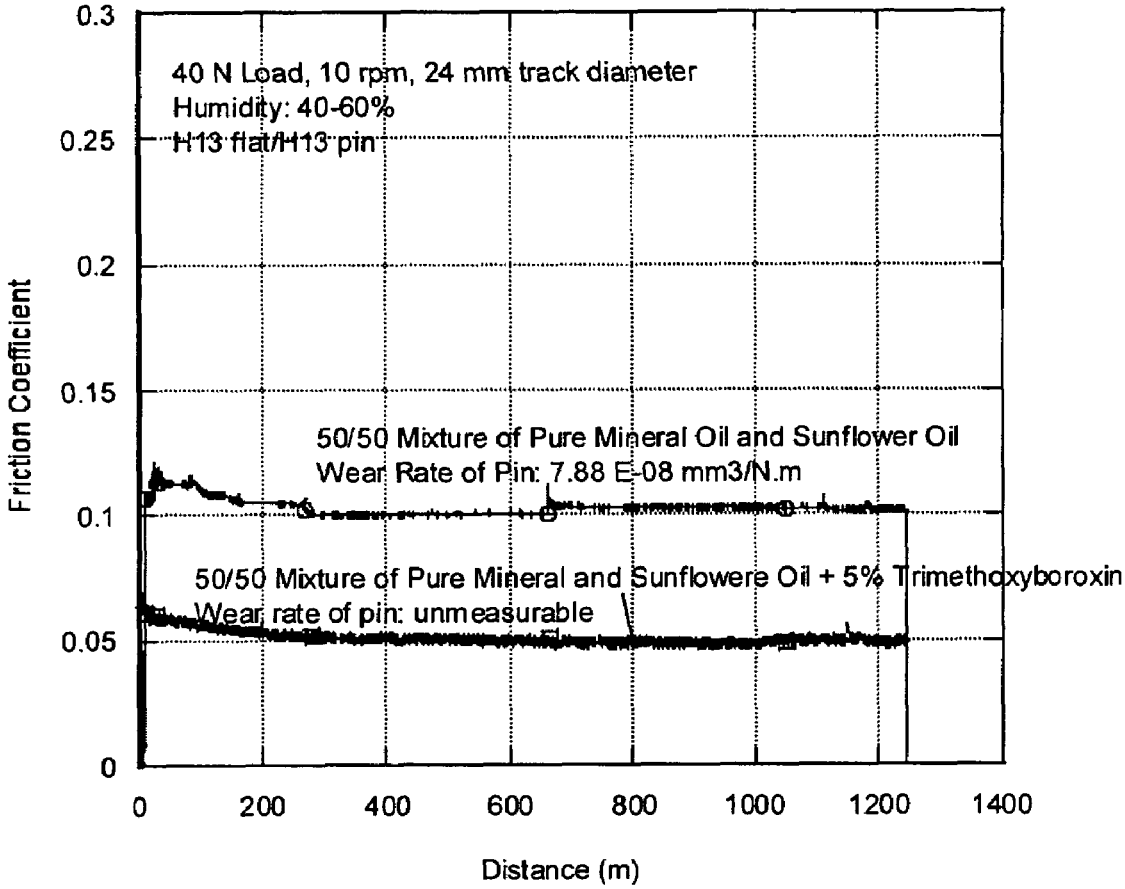
FIG. 13 . is a graph showing the effect of trimethoxyboroxin upon the lubricity performance, as measured by the friction coefficient, of a 50/50 mixture of mineral oil and sunflower oil with a steel pin and steel disk test pair under lubricated sliding conditions.
Figure 14:
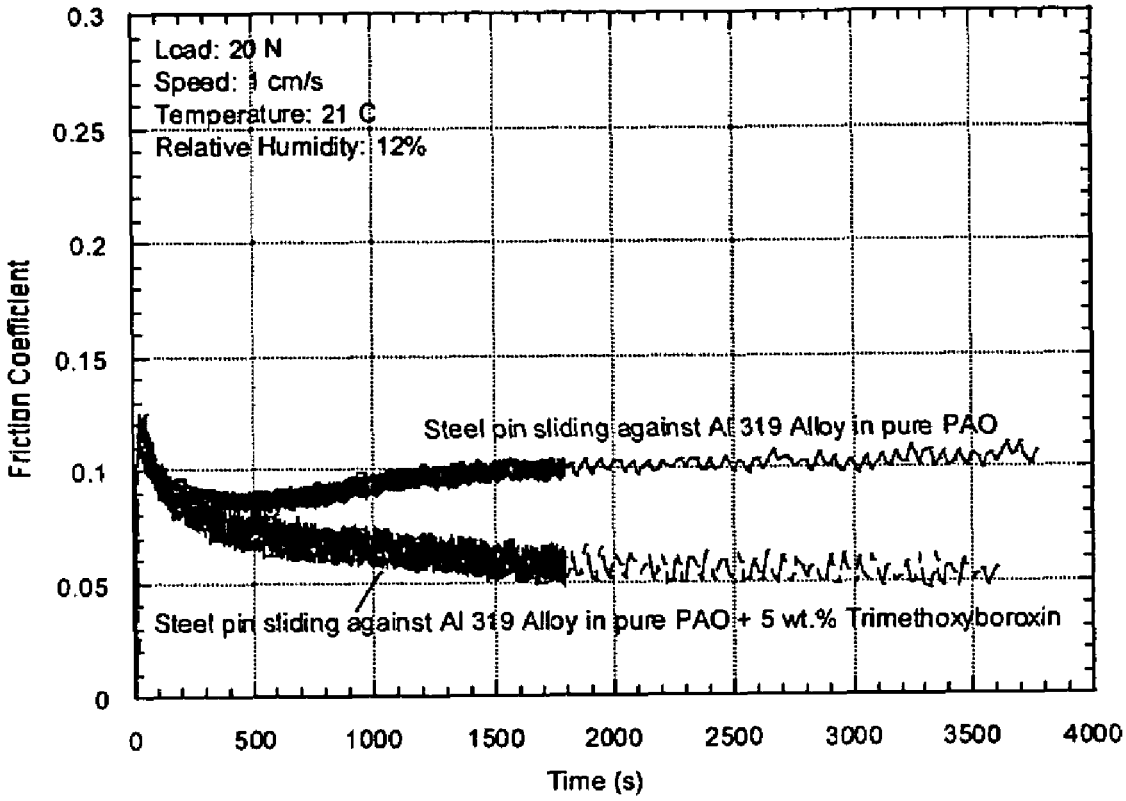
FIG. 14 a graph that shows the effect of trimethoxyboroxin upon the lubricity performance, as measured by the friction coefficient, of pure synthetic oil (PAO) with a steel pin and an aluminum alloy 319 disk pair under lubricated sliding conditions

FIG. 12 shows the effect of trimethoxyboroxin on lubrication performance of sunflower oil (a vegetable base oil). Likewise, FIG. 13 shows the effect of the addition of trimethoxyboroxin on the lubrication performance of a 50/50 mixture of sunflower oil and pure mineral oil. Finally, FIG. 14 shows the effect of the addition of trimethoxyboroxin to a pure synthetic oil (PAO). In each case, the addition of trimethoxyboroxin dramatically decreased the friction coefficient and wear scar diameter.

Thus, in the data shown, both fuels and oils containing the boron compounds of the present invention show significantly reduced wear and friction compared to untreated fuels and oils.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above.

It is understood that the invention is not confined to the particular formulations and arrangements of parts herein illustrated and described, but embraces all such modified forms thereof as come within the scope of the following claims.

What is claimed is:

1. A composition, comprising a diesel fuel, lubricant and a boron compound wherein the boron compound is present as a nanometer-sized powder at a concentration of from about 30 to about 3000 ppm, wherein, the fuel has a sulfur concentration of less than about 500 ppm; and the boron compound is selected from the group consisting of a trialkylborate, a boroxin, or a combination thereof.

2. The composition of claim 1, wherein the boron compound is selected from the group consisting of trimethylborate, trimethoxyboroxin, and combinations thereof.

3. The composition of claim 1, wherein the lubricant is selected from mineral oils, vegetable oils, synthetic oils, greases, and combinations thereof.

* * * * *